US008509470B2

(12) United States Patent
Lee et al.

(10) Patent No.: US 8,509,470 B2
(45) Date of Patent: Aug. 13, 2013

(54) TEXTILE-BASED MAGNETIC FIELD INTERFACE CLOTHES AND MOBILE TERMINAL IN WEARABLE COMPUTING SYSTEM

(75) Inventors: Dong-Woo Lee, Daejeon (KR); Yong-Ki Son, Daejeon (KR); Bae-Sun Kim, Daejeon (KR); Il-Yeon Cho, Daejeon (KR); Hyun-Tae Jeong, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 321 days.

(21) Appl. No.: 12/875,418

(22) Filed: Sep. 3, 2010

(65) Prior Publication Data

US 2011/0058705 A1 Mar. 10, 2011

(30) Foreign Application Priority Data

Sep. 7, 2009 (KR) ..... 10-2009-0084115

(51) Int. Cl.
*H04R 1/02* (2006.01)

(52) U.S. Cl.
USPC ..... 381/388; 381/333; 381/400; 381/401; 381/406; 381/412; 381/334

(58) Field of Classification Search
USPC ..... 381/388, 333–334, 87, 412, 400–401, 381/406; 455/41.1, 79
See application file for complete search history.

(56) References Cited

U.S. PATENT DOCUMENTS

| | | | | |
|---|---|---|---|---|
| 5,774,791 | A * | 6/1998 | Strohallen et al. | 455/41.1 |
| 2007/0036363 | A1* | 2/2007 | Hollemans et al. | 381/59 |
| 2007/0149261 | A1* | 6/2007 | Huddart | 455/575.2 |
| 2007/0250981 | A1 | 11/2007 | Seibert | |
| 2010/0081379 | A1* | 4/2010 | Cooper et al. | 455/41.1 |

FOREIGN PATENT DOCUMENTS

| | | |
|---|---|---|
| JP | 8-032497 | 2/1996 |
| JP | 2007-515563 | 6/2007 |
| JP | 2008-206203 | 9/2008 |
| KR | 10-2004-0006387 | 1/2004 |
| KR | 10-2006-0090112 | 8/2006 |
| KR | 10-2008-0073457 | 8/2008 |
| KR | 10-2008-0088795 | 10/2008 |
| KR | 10-2009-0066513 | 6/2009 |

OTHER PUBLICATIONS

Seulki Lee et al., "A wearable computing network using conductive yarn," A paper of Korean Institute of Next Generation Computing, Mar. 2008, Korea.

* cited by examiner

*Primary Examiner* — Disler Paul
(74) *Attorney, Agent, or Firm* — Staas & Halsey LLP

(57) ABSTRACT

The present invention relates to magnetic field interface clothes performing contactless magnetic field communication with a mobile terminal, the magnetic field interface clothes includes: a receiving part in which a mobile terminal is received and a coil part performing contactless magnetic field communication with a coil part of the mobile terminal at a position facing a coil part of the mobile terminal is formed, wherein the coil part formed in the receiving part includes a first coil and a second coil, the first coil and the second coil are received in the receiving part to have different winding directions.

13 Claims, 12 Drawing Sheets

(a)

(b)

TEXTILE-BASED MAGNETIC FIELD INTERFACE CLOTHES AND MOBILE TERMINAL IN WEARABLE COMPUTING SYSTEM

CROSS REFERENCE TO RELATED APPLICATIONS

This application claims priority to Korean Patent Application No. 10-2009-0084115 filed on Sep. 7, 2009, the entire contents of which are herein incorporated by reference.

BACKGROUND OF THE INVENTION

1. Field of the Invention

The present invention relates to textile-based magnetic field interface clothes and a mobile terminal in a wearable computing system, and more specifically, to textile-based magnetic field interface clothes and a mobile terminal in wearable computing system that perform communication using a magnetic field.

2. Description of the Related Art

With the development of computing technology, a study for providing various types of personal computing environments has been actively conducted. In particular, the wearable computing studying textile and wearable computers is considered as the core field of the next-generation in computing technology.

In the wearable computing field, there is a need for units capable of communicating with various devices, which are dispersed inside and outside a system such as clothes. As a result, a research field of the wearable computing field has developed, that is, a personal area network (PAN) and a fabric area network (FAN), including new methods thereof.

The existing methods can be largely classified into a typical scheme that configures connecting parts on clothes, such as in a removable socket form connecting external devices, and a wireless scheme using a radio. The removable socket scheme, which is the most common scheme, has problems in that the attachment and detachment of the socket is inconvenient since a user needs to directly connect a socket built in the clothes with the mobile terminal and the mobile terminal should be separated from the socket every time the clothes need to be cleaned. In addition, there is a disadvantage in that the user is required to use waterproof treatment on a socket connector part of the clothes.

On the other hand, the wireless scheme using a radio would use the existing low-power short range communication scheme such as radio frequency (RF), Zigbee, Bluetooth, ultra-wideband (UWB).

In this case, in order to perform the short range wireless communication as described above, a predetermined communication module should be installed on the clothes and in order to supply power to the communication module, a separate power supply unit such as a battery is needed. Further, the wireless scheme using a radio is relatively weak in respect to security, such that it is difficult to secure reliable communication.

SUMMARY OF THE INVENTION

The present invention proposes to solve the above problems.

It is an object of the present invention to provide textile-based magnetic field interface clothes and a mobile terminal performing magnetic field communication with the clothes, which can be conveniently attached and detached to the mobile terminal while being water resistant, can be easily fabricated by a weave, and can provide excellent security through magnetic field communication.

Magnetic field interface clothes according to the present invention relates to magnetic field interface clothes performing contactless magnetic field communication with a mobile terminal, the magnetic field interface clothes includes: a receiving part in which a mobile terminal is received and a coil part performing contactless magnetic field communication with a coil part of the mobile terminal at a position facing a coil part of the mobile terminal is formed, wherein the coil part formed in the receiving part, includes a first audio signal receiving coil that receives an L channel audio signal through a magnetic induction scheme from the coil part of the mobile terminal; and a second audio signal receiving coil that receives an R channel audio signal from the coil part of the mobile terminal by using the magnetic induction scheme.

The first audio signal receiving coil and the second audio signal receiving coil are formed in the receiving part to have different winding directions.

The winding direction of the first audio signal receiving coil and the winding direction of the second audio signal receiving coil are orthogonal to each other.

The coil part formed in the receiving part further includes a control signal transmitting coil formed in the receiving part. The control signal transmitting coil has a different winding direction from the ones of the first audio signal receiving coil and the second audio signal receiving coil. The control signal transmitting coil may transmit the control signals for controlling the operation of the mobile terminal to a magnetic field sensor of the mobile terminal by using the magnetic induction scheme.

The magnetic field interface clothes further includes: a signal generator that generates a control signal for controlling the operation of the mobile terminal according to control instructions from a user and transmits the generated control signals to the control signal transmitting coil; an AC/DC converter that is input with alternating current power through the control signal transmitting coil and converts and stores the input alternating power into direct current power; and a time synchronizer that controls the operations of the signal generator and the AC/DC converter so that the signal generator and the AC/DC converter are operated in a time division scheme.

The coil part received in the receiving part further includes a mike signal transmitting coil formed in the receiving part. The mike signal transmitting coil has a different winding direction from the ones of the first audio signal receiving coil and the second audio signal receiving coil. The mike signal transmitting coil may transmit mike signals input through the mike to the magnetic field sensor of the mobile terminal by using the magnetic induction scheme.

Magnetic field interface clothes according to another embodiment relates to magnetic field interface clothes performing contactless magnetic field communication with a mobile terminal, the magnetic field interface clothes includes: a receiving part in which a mobile terminal is received and a coil part performing contactless magnetic field communication with a coil part of the mobile terminal at a position facing a coil part of the mobile terminal is formed, wherein the coil part formed in the receiving part includes a control signal transmitting coil that transmits control signals for controlling the operation of the mobile terminal to a magnetic field sensor of the mobile terminal.

The coil part formed in the receiving part further includes a power transmit signal receiving coil that is formed in the receiving part so as to have a different winding direction from the control signal transmitting coil, wherein the power transfer signal receiving coil receives power transfer signals from the coil part of the mobile terminal.

The winding direction of the control signal transmitting coil and the winding direction of the power transfer signal receiving coil are orthogonal to each other.

Magnetic field interface clothes according to another embodiment relates to the magnetic field interface clothes performing contactless magnetic field communication with a mobile terminal, the magnetic field interface clothes includes: a receiving part in which a mobile terminal is received and a coil part performing contactless magnetic field communication with a coil part of the mobile terminal at a position facing a coil part of the mobile terminal is formed, wherein the coil part formed in the receiving part includes a first coil and a second coil, the first coil and the second coil are received in the receiving part to have different winding directions.

The winding direction of the first coil and the winding direction of the second coil are orthogonal to each other.

A mobile terminal according to another embodiment of the present invention relates to a mobile terminal received in magnetic field interface clothes and performing contactless magnetic field communication with the magnetic field interface clothes, the mobile terminal includes: a coil part performing the contactless magnetic field communication with a coil part of the magnetic field interface clothes at a position facing a coil part of the magnetic field interface clothes is formed, wherein the coil part performing the contactless magnetic field communication with the coil part of the magnetic field interface clothes includes a first audio signal transmitting coil that transmits an L channel audio signal to the coil part of the magnetic field interface clothes through a magnetic induction scheme; and a second audio signal transmitting coil that transmits an R channel audio signal to the coil part of the magnetic field interface clothes by using the magnetic induction scheme.

The first audio signal transmitting coil and the second audio signal transmitting coil are formed to have different winding directions.

The winding direction of the first audio signal transmitting coil and the winding direction of the second audio signal transmitting coil are orthogonal to each other.

The mobile terminal further includes a magnetic field sensor that receives control signals for controlling the operation of the mobile terminal, which are transmitted from the coil part of the magnetic field interface clothes by using the magnetic induction scheme.

The coil part performing the contactless magnetic field communication with the coil part of the magnetic field interface clothes further includes a power transfer signal transmitting coil that transmits power transfer signals to the coil part of the magnetic field interface clothes by using the magnetic induction scheme.

The mobile terminal further includes a magnetic field sensor that receives mike signals transmitted from the coil part of the magnetic field interface clothes by using the magnetic induction scheme.

The first audio signal transmitting coil and the second audio signal transmitting coil are formed in the external apparatus that is connected to the external connector of the mobile terminal.

A mobile terminal according to another embodiment of the present invention relates to a mobile terminal received in magnetic field interface clothes and performing contactless magnetic field communication with the magnetic field interface clothes, the mobile terminal including: a power transfer signal transmitting coil that transmits power transfer signals to a coil part of the magnetic field interface clothes using a magnetic induction scheme at a position facing a coil part of the magnetic field interface clothes is formed; and a magnetic field sensor that receives control signals for controlling the operation of the mobile terminal, which are transmitted from the coil part of the magnetic field interface clothes using the magnetic induction scheme.

The following effects can be obtained by the present invention.

In the wearable computing system according to the present invention, the interface, which can communicate clothes with the mobile terminal, can be made without directly connecting the clothes with the mobile terminal (for example, a form receiving the mobile terminal in the pocket).

In addition, since the mobile terminal is received when close to the clothes in order to perform the magnetic field communication, the mobile terminal can efficiently increase signal transmission efficiency including a low power structure while minimizing the signal attenuation phenomenon due to noise by accurately maintaining an axis arrangement at the time of performing the magnetic field communication between the coils having different axis arrangement.

Moreover, since the clothes have a part made of conductive yarn according to the system, the durability is excellent and since natural clothes configured of only textile can be made, the clothes can be freely designed.

DETAILED DESCRIPTION OF THE PREFERRED EMBODIMENTS

Figure 1:
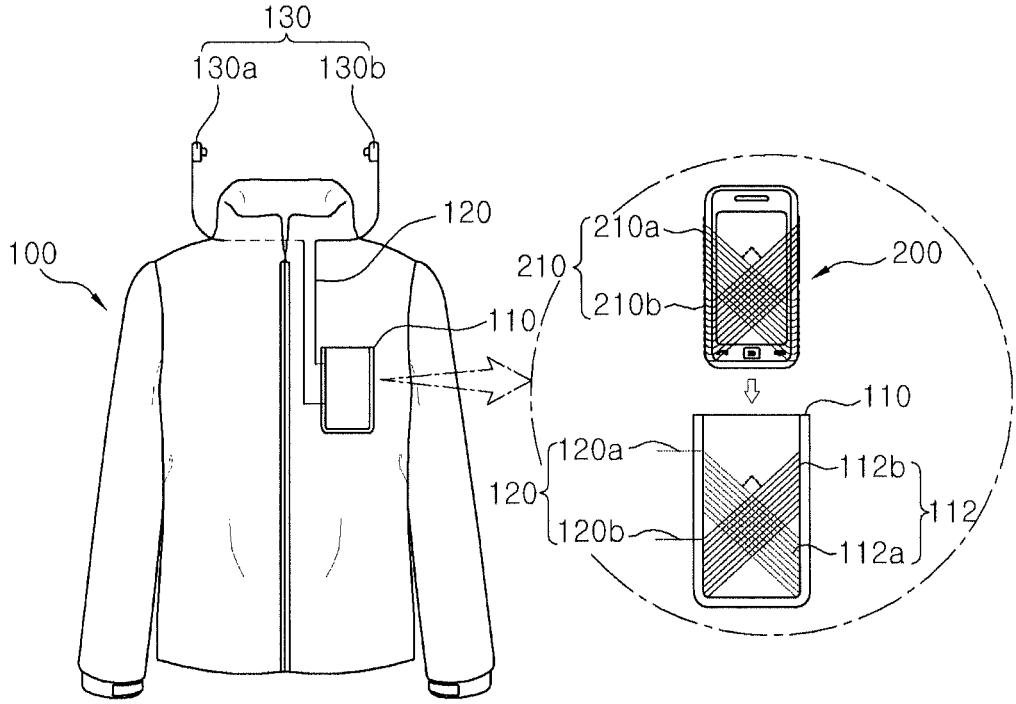
FIG. 1 is an exemplified diagram for explaining a wearable computing system according to a first embodiment of the present invention.

The present invention will be described below with reference to the accompanying drawings. Herein, the detailed description of a related known function or configuration that may make the purpose of the present invention unnecessarily ambiguous in describing the present invention will be omitted. Exemplary embodiments of the present invention are provided so that those skilled in the art may more completely understand the present invention. Accordingly, the shape, the size, etc., of elements in the drawings may be exaggerated for explicit comprehension.

Hereinafter, preferred embodiments of the present invention will be described in detail with reference to the accompanying drawings.

Coils formed on a mobile terminal and clothes are represented by a solid line in the following drawings. This is to help understand the present invention by describing in more detail the shapes of the coils but does not mean that the coils are formed on the outer surface of the mobile terminal and the clothes.

First Embodiment

Figure 2:
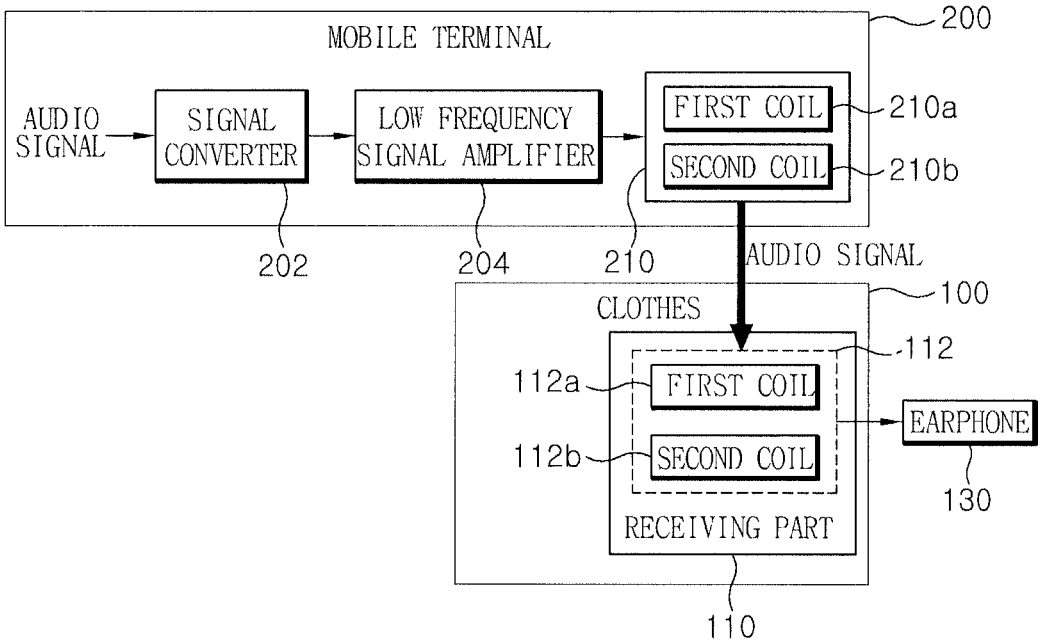
FIG. 2 is a block diagram for explaining in detail a configuration of textile-based magnetic field interface clothes and a mobile terminal in the wearable computing system of FIG. 1.

FIG. 1 is an exemplified diagram for explaining a wearable computing system according to a first embodiment of the present invention. FIG. 2 is a block diagram for explaining in detail a configuration of textile-based magnetic field interface clothes and a mobile terminal in the wearable computing system of FIG. 1.

The wearable computing system according to the first embodiment of the present invention includes textile-based magnetic field interface clothes 100 (hereinafter, referred to as 'clothes') and a mobile terminal 200.

Referring to FIGS. 1 and 2, the clothes 100 are provided with a receiving part (for example, a pocket) and the mobile terminal 200 of the user is received in the receiving part 110. In this case, it is preferable that a size of the receiving part 110 is the same as that of the mobile terminal 200 or the mobile terminal 200 is formed to have only a slight gap. This is to more stably perform magnetic field communication by increasing a flux density when the mobile terminal 200 performs contactless magnetic field communication with the clothes 100. In the case of the magnetic field communication, the longer the distance, the more signal attenuation increases. As a result, it is preferable that a transmitting end and a receiving end are formed to be close to each other. In the present invention, since the mobile terminal 200 can be closely received in the clothes 100 in order to perform magnetic field communication, signal transmission efficiency becomes high, such that the low-power structure can be formed and the axis arrangement can be accurately maintained when the magnetic field communication is performed between the coils having different axis arrangements, and minimize the signal attenuation phenomenon due to noise.

The receiving part 110 is formed with a secondary coil part that performs contactless magnetic field communication with a primary coil part 210 of the mobile terminal 200. The contactless magnetic field communication is a wireless communication method using a basic principle that generates magnetic field around a conducting wire into which current flows and induces current to adjacent conducting wires due to the change in the magnetic field. The present invention uses the magnetic field communication method to communicate with the clothes 100 that has the mobile terminal 200.

The secondary coil part 112 is configured of a first coil 112*a* and a second coil 112*b*, which are made of conductive yarn (conducting wires in the textile form). In this case, the first coil 112*a* and the second coil 112*b* are formed on the receiving part 110 to have different axis arrangements. For example, the first coil 112*a* is formed to be wound in an X-axis direction along an internal surface or an external surface of the receiving part 110 and the second coil 112*b* is formed to be wound in a Y-axis direction along the internal surface or the external surface of the receiving part.

The secondary coil part 112 receives an audio signal transmitted through a magnetic induction scheme from the primary coil part of the mobile terminal 200.

The secondary coil part 112 is electrically connected to an external audio output apparatus 130 (for example, 'earphone') through the conductive yarn 120 formed on the clothes 100. For example, the first coil 112*a* of the secondary coil part 112 may be electrically connected to an L channel 130*b* of the audio output apparatus 130 through the first conductive yarn 120*a* and the second coil 112*b* of the secondary coil part 112 may be electrically connected to an R channel 130*a* of the audio output apparatus 130 through the second conductive yarn 120*b*.

Herein, the first coil 112*a* and the second coil 112*b* correspond to a first audio signal receiving coil and a second audio signal receiving coil, which are described in the claims.

Meanwhile, the mobile terminal 200 includes a signal converter 202, a low frequency signal amplifier 204, and the primary coil part 210.

The signal converter 202 receives the audio signals and converts them into a form capable of transmitting the audio signals in the primary coil part 210 by using the magnetic induction scheme.

The signals converted in the signal converter 202 is transmitted to the low frequency signal amplifier 204 and the low frequency signal amplifier 204 receives the converted signals, amplifies signals corresponding to a low frequency band, and transmits them to the primary coil part 210. The signal converter 202 often means an equalizer.

The signals transmitted to the primary coil part 210 are transmitted to the secondary coil part 112 on the clothes 100 by using the magnetic induction scheme and the transmitted signals are output through the audio output apparatus 130 without needing to configure specific circuits on the clothes 100. In other words, the signals transmitted to the first coil 210*a* of the primary coil part 210 is transmitted to the first coil 112*a* of the secondary coil part 112 by using the magnetic induction scheme and the signals transmitted to the second coil 210*b* of the primary coil part 210 are transmitted to the second coil 112*b* of the secondary coil part 112 by using the magnetic induction scheme.

Herein, the first coil 210*a* and the second coil 210*b* correspond to a first audio signal transmitting coil and a second audio signal transmitting coil, respectively, which are described in the claims.

With the above configuration, since the clothes 100 have a part made of conductive yarn, the durability is excellent and the clothes can be naturally made of only textile, which allows the clothes to be freely designed. In particular, since the clothes are not limited to specific washing methods as well as not requiring a separate battery for supplying power to the audio output apparatus, there is no inconvenience to the user due to the attachment and detachment of a battery necessary for a specific washing method.

Figure 13:
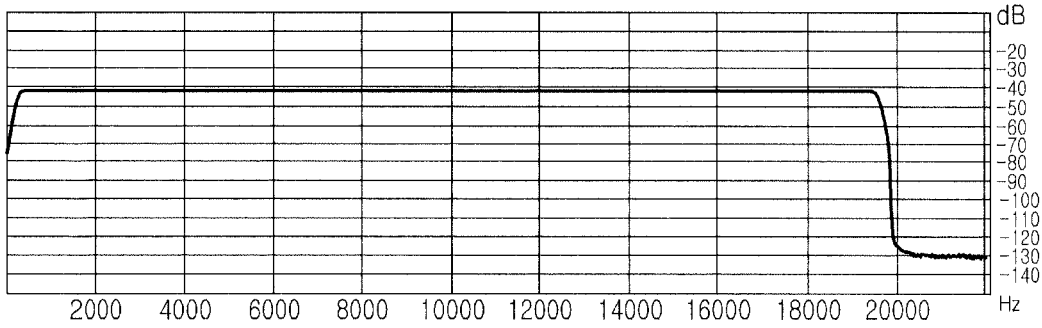
FIG. 13 is a diagram for explaining frequency characteristics of an audio signal transmitted through contactless magnetic field communication.
Figure 13:
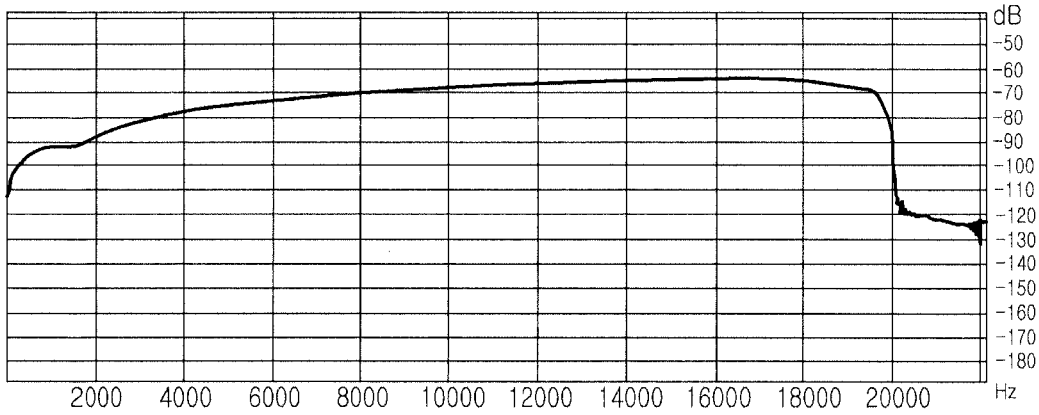

Meanwhile, the signals induced to the secondary coil part 112 on the clothes 100 are attenuated in a low frequency band due to material characteristics of the first coil 112*a* and the second coil and frequency characteristics due to electromagnetic induction (see FIG. 13). For this reason, in order to transmit high quality audio signals, it is required to amplify the signals of the low frequency band. Therefore, the low frequency signal amplifier 204 of the present invention amplifies the signals of the low frequency band in the audio signals to be transmitted and transmits them to the primary coil part 210.

Second Embodiment

Figure 3:
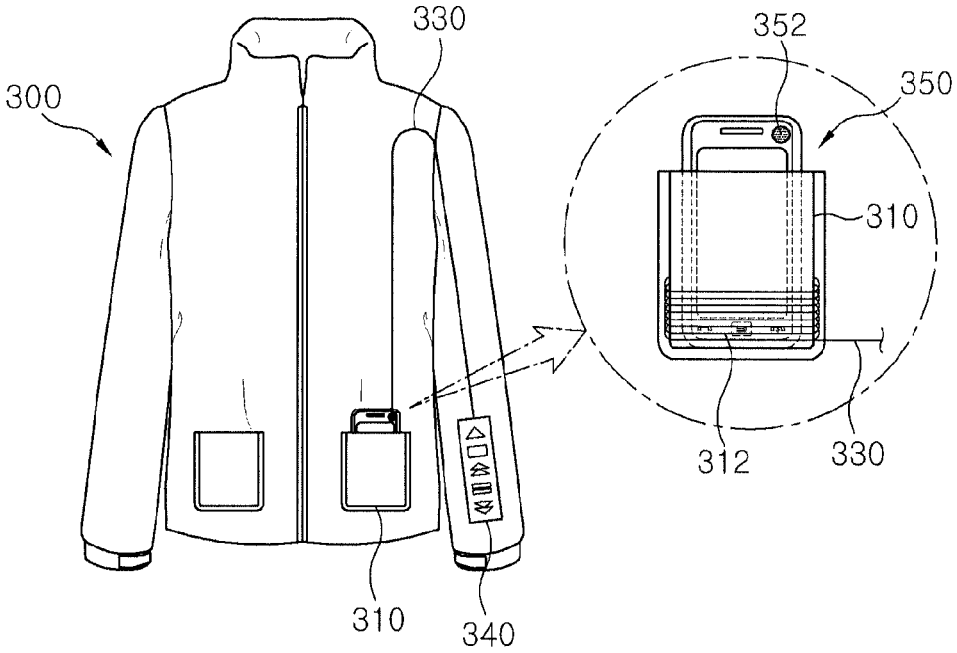
FIG. 3 is an exemplified diagram for explaining a wearable computing system according to a second embodiment of the present invention.
Figure 4:
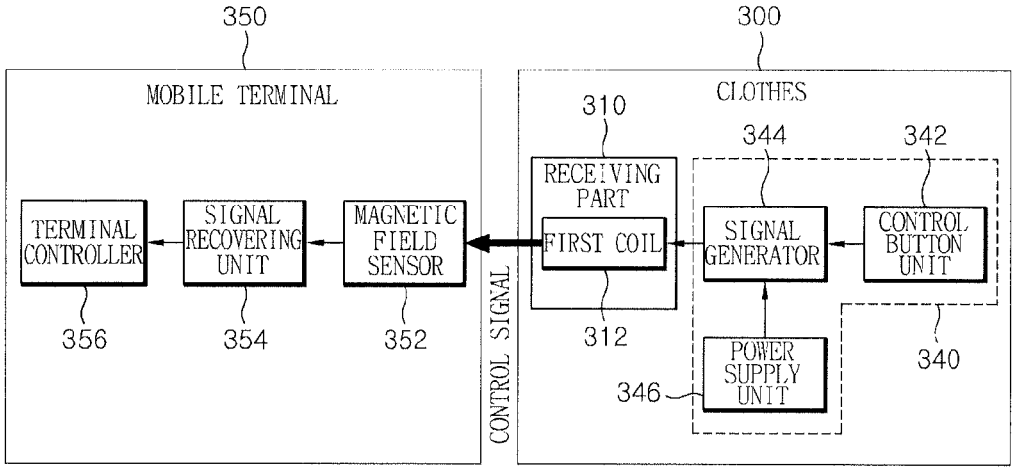
FIG. 4 is a block diagram for explaining in detail a configuration of textile-based magnetic field interface clothes and a mobile terminal in the wearable computing system of FIG. 3.

FIG. 3 is an exemplified diagram for explaining a wearable computing system according to a second embodiment of the present invention. FIG. 4 is a block diagram for explaining in detail a configuration of textile-based magnetic field interface clothes and a mobile terminal in the wearable computing system of FIG. 3.

The wearable computing system according to the second embodiment of the present invention includes textile-based magnetic field interface clothes 300 (hereinafter, referred to as 'clothes') and a mobile terminal 350.

Referring to FIGS. 3 and 4, the clothes 300 are provided with a receiving part 310 and the mobile terminal 350 of the user is received in the receiving part 310. In this case, it is preferable that a size of the receiving part 310 is the same as that of the mobile terminal 350 or the mobile terminal 350 is formed to have only a slight gap. This is to more stably perform magnetic field communication by increasing a flux density when the mobile terminal 350 performs contactless magnetic field communication with the clothes 300.

The receiving part 310 is formed with a first coil 312 that transmits control signals to a magnetic field sensor 352 by using the magnetic induction scheme. The first coil 312 is operated as the primary coil part and is wound along the internal surface or the external surface of the receiving part 310.

Herein, the first coil 312 corresponds to the control signal transmitting coil, which is described in the claims.

The clothes 300 include a control signal generator 340 that generates the control signals for controlling the operation of the mobile terminal 350 according to the control instructions from the user and the control signal generator 340 is electrically connected to the first coil 312 formed in the receiving part 310 through the conductive yarn 330.

More specifically, the control signal generator 340 includes a control button unit 342, a signal generator 344, and a power supply unit 346.

It is preferable that the control button unit 342 is a user interface unit to receive the control instructions from the user and is made of a textile in consideration of the clothes washing method, etc.

The signal generator 344 generates the control signals corresponding to the user instructions input through the control button unit 342 and transmits them to the first coil 312. In this case, the signal generator 344 may use a modulation method, such as AM, FM, digital, etc.

The power supply unit 346 performs a role of supplying power necessary to generate the control signals in the signal generator 344. Generally, the power supply unit such as a battery may be applied.

Meanwhile, the mobile terminal 350 includes a magnetic field sensor 352, a signal recovering unit 354, and a terminal controller 356.

The magnetic field sensor 352 senses control signals transmitted from the first coil 312 on the clothes by using the magnetic induction scheme and transmits the sensed control signals to the signal recovering unit 354. As the magnetic field sensor 352, a uniaxial magnetic field sensor for sensing the control signals transmitted from the first coil 312 or a magnetic inducible coil can be used.

The signal recovering unit 354 detects the control signals sensed in the magnetic field sensor 352 using a band-pass filter, etc.

The terminal controller 356 controls the operation of the mobile terminal 350 (for example, music reproduction, etc.) based on the control signals detected through the signal recovering unit 354.

Through the above configuration, the mobile terminals, such as a mobile phone, an MP3 player, a PMP, etc., can be controlled using the magnetic field communication without using connecting units such as a connector.

Third Embodiment

Figure 5:
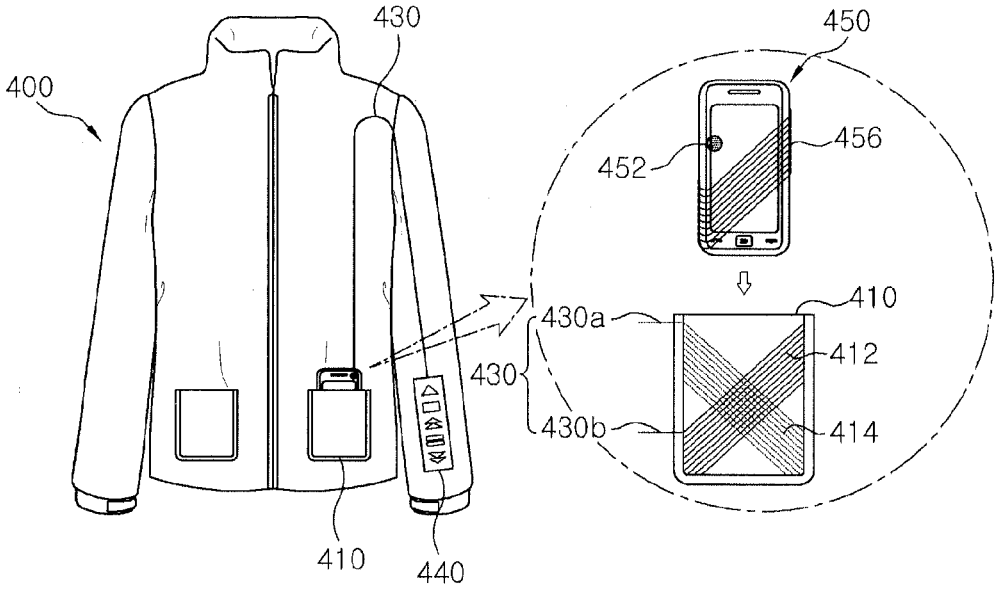
FIG. 5 is an exemplified diagram for explaining a wearable computing system according to a third embodiment of the present invention.
Figure 6:
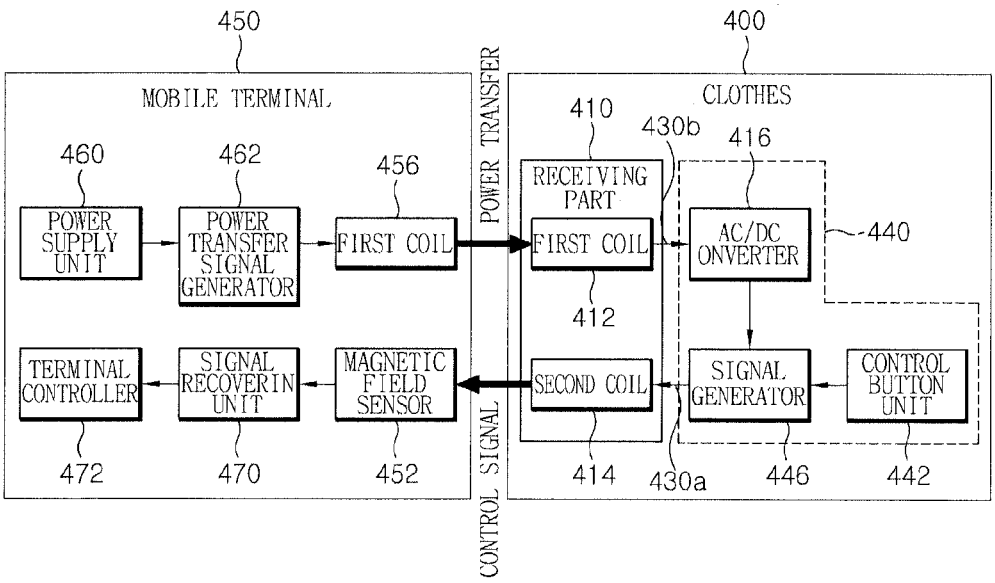
FIG. 6 is a block diagram for explaining in detail a configuration of textile-based magnetic field interface clothes and a mobile terminal in the wearable computing system of FIG. 5.

FIG. 5 is an exemplified diagram for explaining a wearable computing system according to a third embodiment of the present invention. FIG. 6 is a block diagram for explaining in detail a configuration of textile-based magnetic field interface clothes and a mobile terminal in the wearable computing system of FIG. 5.

The wearable computing system according to the third embodiment of the present invention includes textile-based magnetic field interface clothes 400 (hereinafter, referred to as 'clothes') and a mobile terminal 450.

Comparing the third embodiment with the second embodiment, a control signal generator 440 in the third embodiment does not include a separate power supply unit (for example, the power supply unit of FIG. 4), unlike the control signal generator 340 in the second embodiment. In other words, the control signal generator 440 of FIG. 6 is operated by being supplied with power from the portable terminal 400 by using the magnetic induction scheme, which will be described below in more detail.

Referring to FIGS. 5 and 6, the clothes 400 are provided with a receiving part (for example, pocket) and the mobile terminal 450 of the user is received in the receiving part 410. In this case, it is preferable that a size of the receiving part 410 is the same as that of the mobile terminal 450 or the mobile terminal 450 is formed to have only a slight gap. This is to more stably perform magnetic field communication by increasing a flux density when the mobile terminal 450 perform contactless magnetic field communication with the clothes 400. In the present invention, since the mobile terminal 450 is received closed to the clothes 400 in order to perform the magnetic field communication, the mobile terminal can increase signal transfer efficiency having a low power structure and can minimize the signal attenuation phenomenon due to noise by accurately maintaining an axis arrangement at the time of performing the magnetic field communication between the coils having different axis arrangement.

The receiving unit 410 is formed with a secondary coil part (first coil 412) performing contactless magnetic field communication with a primary coil part (first coil 456) of the mobile terminal 450, and a primary coil part (second coil 414) transmitting control signals from the control signal generator 440 to a magnetic field sensor 452 of the mobile terminal 450 by using the magnetic induction scheme.

The first coil 412 operated as the second coil part and the second coil 414 operated as the primary coil part are made of conductive yarn (conductive wires in the form of textile) and the first coil 412 and the second coil 414 are formed on the receiving part 410 to have different axial arrangements. For example, the first coil 412 is formed to be wound in an X-axis direction along an internal surface or an external surface of the receiving unit 410 and the second coil 414 is formed to be wound in a Y-axis direction along the internal surface or the external surface of the receiving part 410.

The clothes 400 include a control signal generator 440 that generates the control signals for controlling the operation of the mobile terminal 450 according to the control instructions from the user and the control signal generator 440 is electrically connected to the first coil 412 and the second coil 414 formed in the receiving part 410 through the conductive yarn 430.

Herein, the first coil 412 and the second coil 414 correspond to the power transfer signal receiving coil and the control signal transmitting coil, respectively, which are described in the claims.

Describing in more detail with reference to FIG. 6, the control signal generator 440 includes an AC/DC converter 416, a signal generator 446, and a control button unit 442.

The AC/DC converter 416 is electrically connected to the first coil 412 of the receiving part 410 through the first conductive yarn 430*a*, receives alternating current power from the first coil 412 and converts it into direct current power, and supplies it to the signal generator 446.

The control button unit 442 is a user interface unit for receiving the control instructions from the user and is configured in the form of textile.

The signal generator 446 generates the control signals corresponding to the user instructions input through the control button unit 442 and transmits them to the second coil 414 of the receiving part 410. In this case, the signal generator 446 may use a modulation method, such as AM, FM, digital, etc.

Meanwhile, the mobile terminal 450 includes a power supply unit 460, a power transfer signal generator 462, the first coil 456, a terminal controller 472, a signal recovering unit 470, and the magnetic field sensor 452.

The power transfer signal generator 462 receives power from the power supply unit 460 and generates power transfer signals for supplying power to the control signal generator 440 on the clothes 400.

The power transfer signals generated in the power transfer signal generator 462 are transmitted to the first coil 456 and the first coil 456 transmits the power transfer signals to the first coil 412 on the clothes 400 by using the magnetic induction scheme. Herein, the first coil 456 of the mobile terminal 450 corresponds to the power transfer signal transmitting coil, which is described in the claims.

The magnetic field sensor 452 senses the control signals transmitted from the second coil 414 on the clothes 400 by using the magnetic induction scheme and transmits the sensed control signals to the signal recovering unit 470. As the magnetic field sensor 452, the uniaxial magnetic field sensor for sensing the control signals transmitted from the second coil 414 or the magnetic inducible coil can be used.

The signal recovering unit 470 detects the control signals sensed in the magnetic field sensor 452 using the band-pass filter, etc.

The terminal controller 472 controls the operation of the mobile terminal 450 (for example, music reproduction, etc.) based on the control signals detected through the signal recovering unit 470. Through the above configuration, the mobile terminals, such as a mobile phone, an MP3 player, a PMP, etc., can be controlled using the magnetic field communication without using connection units such as a connector.

With the above configuration, since a separate battery for supplying power to the control signal generator 440 is not needed, there is no inconvenience to the user due to the attachment and detachment of a battery necessary for performing a specific washing method.

Fourth Embodiment

Figure 7:
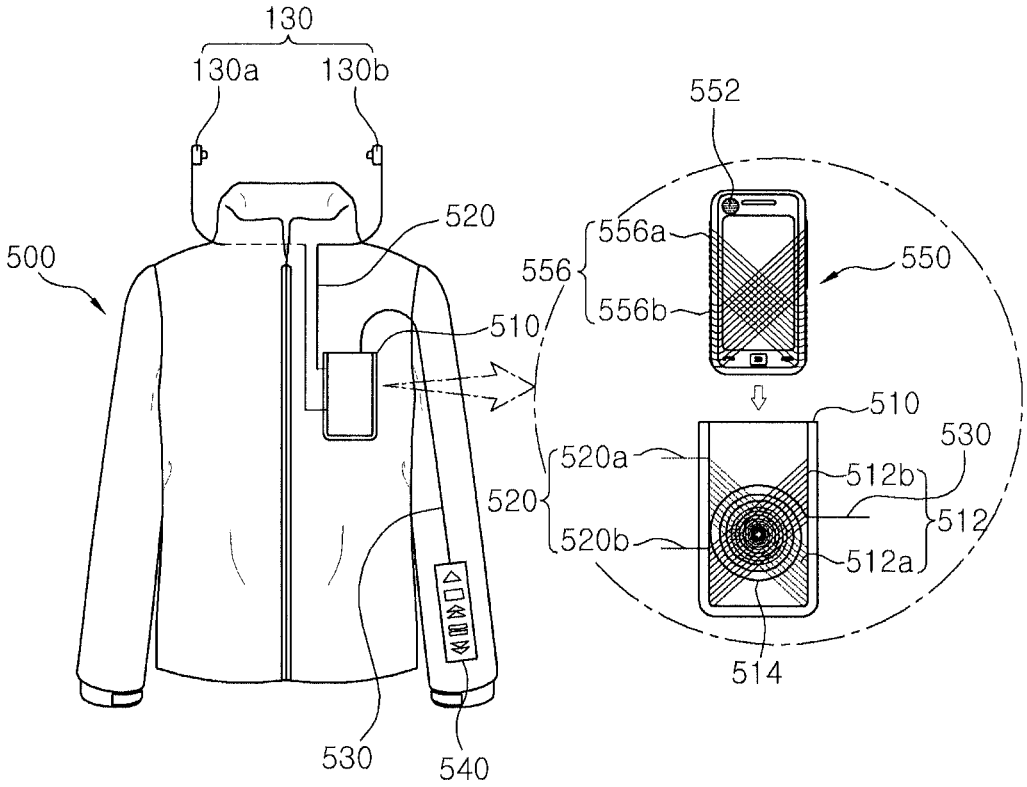
FIG. 7 is an exemplified diagram for explaining a wearable computing system according to a fourth embodiment of the present invention.
Figure 8:
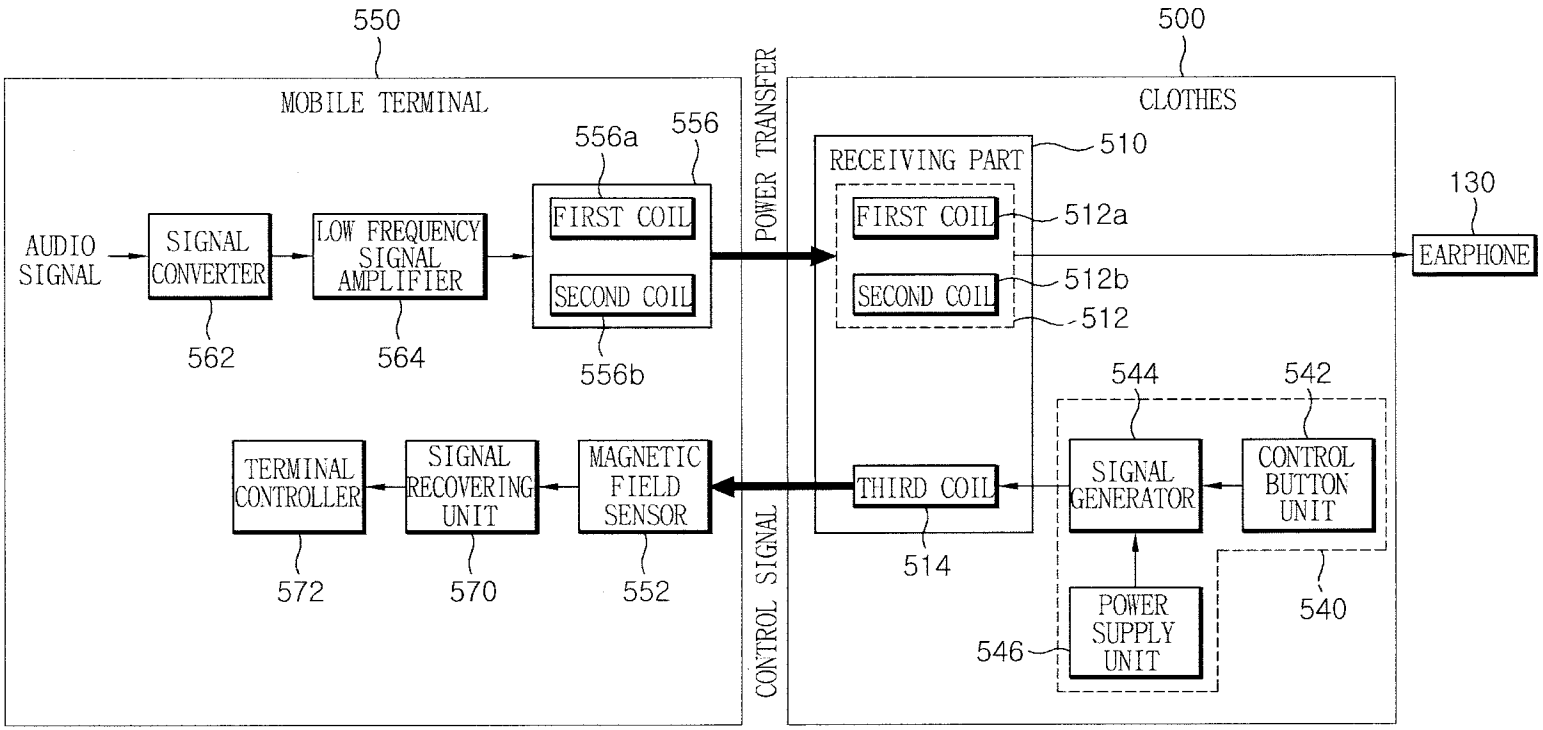
FIG. 8 is a block diagram for explaining in detail a configuration of textile-based magnetic field interface clothes and a mobile terminal in the wearable computing system of FIG. 7.

FIG. 7 is an exemplified diagram for explaining a wearable computing system according to a fourth embodiment of the present invention. FIG. 8 is a block diagram for explaining in detail a configuration of textile-based magnetic field interface clothes and a mobile terminal in the wearable computing system of FIG. 7.

The wearable computing system according to the fourth embodiment of the present invention includes textile-based magnetic field interface clothes 500 (hereinafter, referred to as 'clothes') and a mobile terminal 550.

Referring to FIGS. 7 and 8, the clothes 500 are provided with a receiving part 510 and the mobile terminal 550 of the user is received in the receiving part 510. In this case, it is preferable that a size of the receiving part 510 is the same as that of the mobile terminal 550 or the mobile terminal 550 is formed to have only a slight gap. This is to more stably perform magnetic field communication by increasing a flux density when the mobile terminal 550 performs contactless magnetic field communication with the clothes 500. In the present invention, since the mobile terminal 550 is received close to the clothes 500 to perform the magnetic field communication, the mobile terminal can increase the signal transfer efficiency by having a low power structure and minimize the signal attenuation phenomenon due to noise by accurately maintaining an axis arrangement at the time of performing the magnetic field communication between the coils having different axis arrangement.

The receiving unit 510 is formed with a secondary coil part 512 performing contactless magnetic field communication with a primary coil part 556 of the mobile terminal 550 and a primary coil part 514 (third coil) transmitting control signals to a magnetic field sensor 552 of the mobile terminal 550 by using the magnetic induction scheme.

The secondary coil part 512 of the receiving part 510 is configured of a first coil 512*a* and a second coil 512*b*, which are made of conductive yarn (a conducting wire in the form of textile). In this case, the first coil 512*a* and the second coil 112*b* are formed on the receiving part 510 to have different axis arrangements. For example, the first coil 512*a* is formed to be wound in an X-axis direction along an internal surface or an external surface of the receiving unit 510 and the second coil 512*b* is formed to be wound in a Y-axis direction along the internal surface or the external surface of the receiving part 510.

The secondary coil part 512 is electrically connected to an external audio output apparatus 130 (for example, 'earphone') through the conductive yarn 520 formed on the clothes 500. For example, the first coil 512*a* of the secondary coil part 512 may be electrically connected to the L channel 130*b* of the audio output apparatus 130 through the first conductive yarn 520*a* and the second coil 512*b* of the secondary coil part 512 may be electrically connected to an R channel 130*a* of the audio output apparatus 130 through the second conductive yarn 520*b*.

In addition, the receiving part 510 is formed with the primary coil part 514 (third coil) made of conductive yarn and the third coil 514 is formed in the receiving part 510 to have an axis arrangement different from the first coil 512*a* and the second coil 512*b* of the secondary coil part 512. For example, the third coil 514 is formed in a twister shape to have a Z-axis arrangement on the internal surface or the outer surface of the receiving part 510 (see FIG. 7).

Herein, the first coil 512*a*, the second coil 512*b*, and the third coil 514 correspond to a first audio signal receiving coil, a second audio signal receiving coil, and a control signal transmitting coil, respectively, which are described in claims.

The clothes 500 include a control signal generator 540 that generates the control signals for controlling the operation of the mobile terminal 550 according to the control instructions from the user and the control signal generator 540 is electrically connected to the third coil 514 formed in the receiving part 510 through the conductive yarn 530.

The control signal generator 540 includes a control button unit 542, a signal generator 544, and a power supply unit 546.

The control button unit 542 is a user interface unit for receiving the control instructions from the user and is configured in the form of textile.

The signal generator 544 generates the control signals corresponding to the user instructions input through the control button unit 542 and transmits them to the third coil 514. In this case, the signal generator 544 may use a modulation method, such as AM, FM, digital, etc.

The power supply unit 546 performs a role of supplying power necessary to generate the control signals in the signal generator 544. Generally, the power supply unit such as a battery may be applied.

Meanwhile, the mobile terminal 550 includes a signal converter 562, a low frequency signal amplifier 564, the primary coil part 556, the magnetic field sensor 552 includes a signal recovering unit 570, and a terminal controller 572.

The signal converter 562 receives the audio signals and converts them into a form capable of transmitting the audio signals in the primary coil part 556 by using the magnetic induction scheme.

The signals converted in the signal converter 562 is transmitted to the low frequency signal amplifier 564 and the low frequency signal amplifier 564 receives the converted signals, amplifies signals corresponding to a low frequency band, and transmits them to the primary coil part 556.

The signals transmitted to the primary coil part 556 are transmitted to the secondary coil part 512 on the clothes by using the magnetic induction scheme and the transmitted signals are output through the audio output apparatus 130 without needing to configure specific circuits on the clothes 500. In other words, the signals transmitted to the first coil 556*a* of the primary coil part 556 is transmitted to the first coil 512*a* of the secondary coil part 512 by using the magnetic induction scheme and the signals transmitted to the second coil 556*b* of the primary coil part 556 are transmitted to the second coil 512*b* of the secondary coil part 512 by using the magnetic induction scheme. Herein, the first coil 556*a* and the second coil 556*b* of the primary coil part 556 correspond to a first audio signal transmitting coil and a second audio signal transmitting coil, respectively, which are described in claims.

The magnetic field sensor 552 senses control signals transmitted from the third coil 514 of the receiving part 510 by using the magnetic induction scheme and transmits the sensed control signal to the signal recovering unit 570. As the magnetic field sensor 552, the uniaxial magnetic field sensor for sensing the control signals transmitted from the third coil 514 or the magnetic inducible coil can be used.

The signal recovering unit 570 detects the control signals sensed in the magnetic field sensor 552 using a band-pass filter, etc.

The terminal controller 572 controls the operation of the mobile terminal 550 (for example, music reproduction, etc.) based on the control signals detected through the signal recovering unit 570.

Through the above configuration, the mobile terminals, such as a mobile phone, an MP3 player, a PMP, etc., can be controlled using the magnetic field communication without using connection units such as a connector. In addition, since the wearable computing system of the present invention performs multi-axial magnetic field communication, the bidirectional information transmission between the clothes 500 and the mobile terminal 550 can be made. In other words, it is possible to control the operation of the mobile terminal 550 while the audio signal of the mobile terminal 550 is transmitted to the external audio output apparatus and at the same time, the control signals generated in the control signal generator 540 are transmitted to the mobile terminal 550.

Fifth Embodiment

Figure 9:
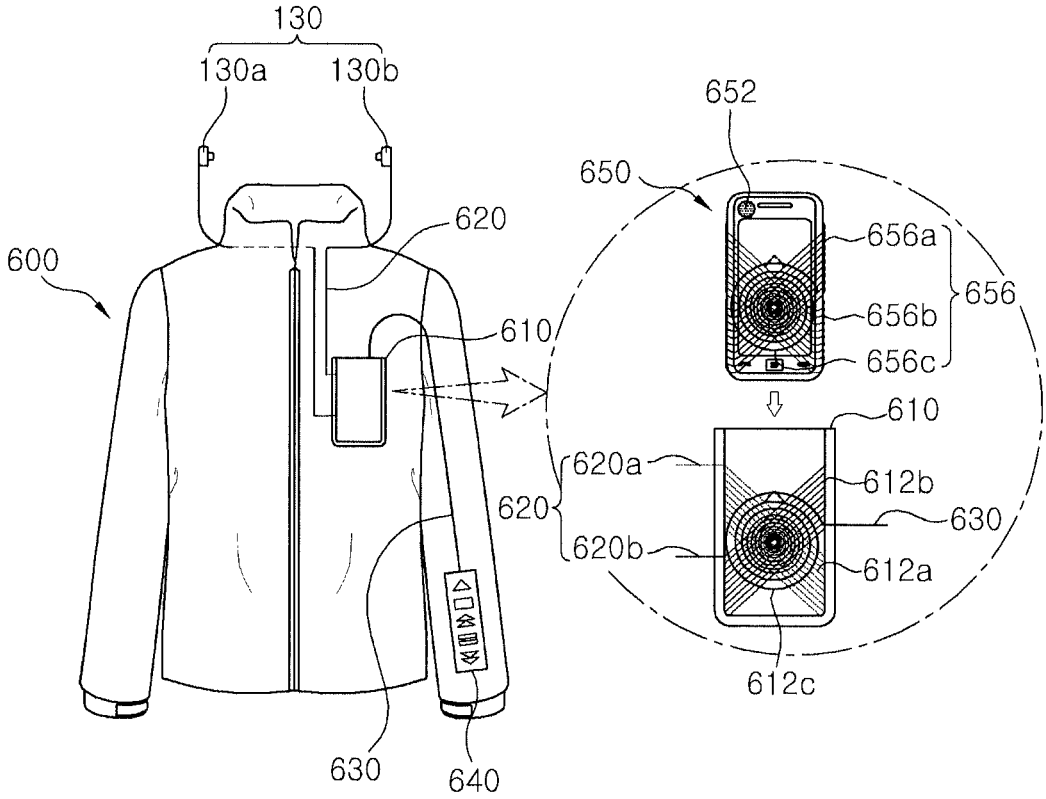
FIG. 9 is an exemplified diagram for explaining a wearable computing system according to a fifth embodiment of the present invention.
Figure 10:
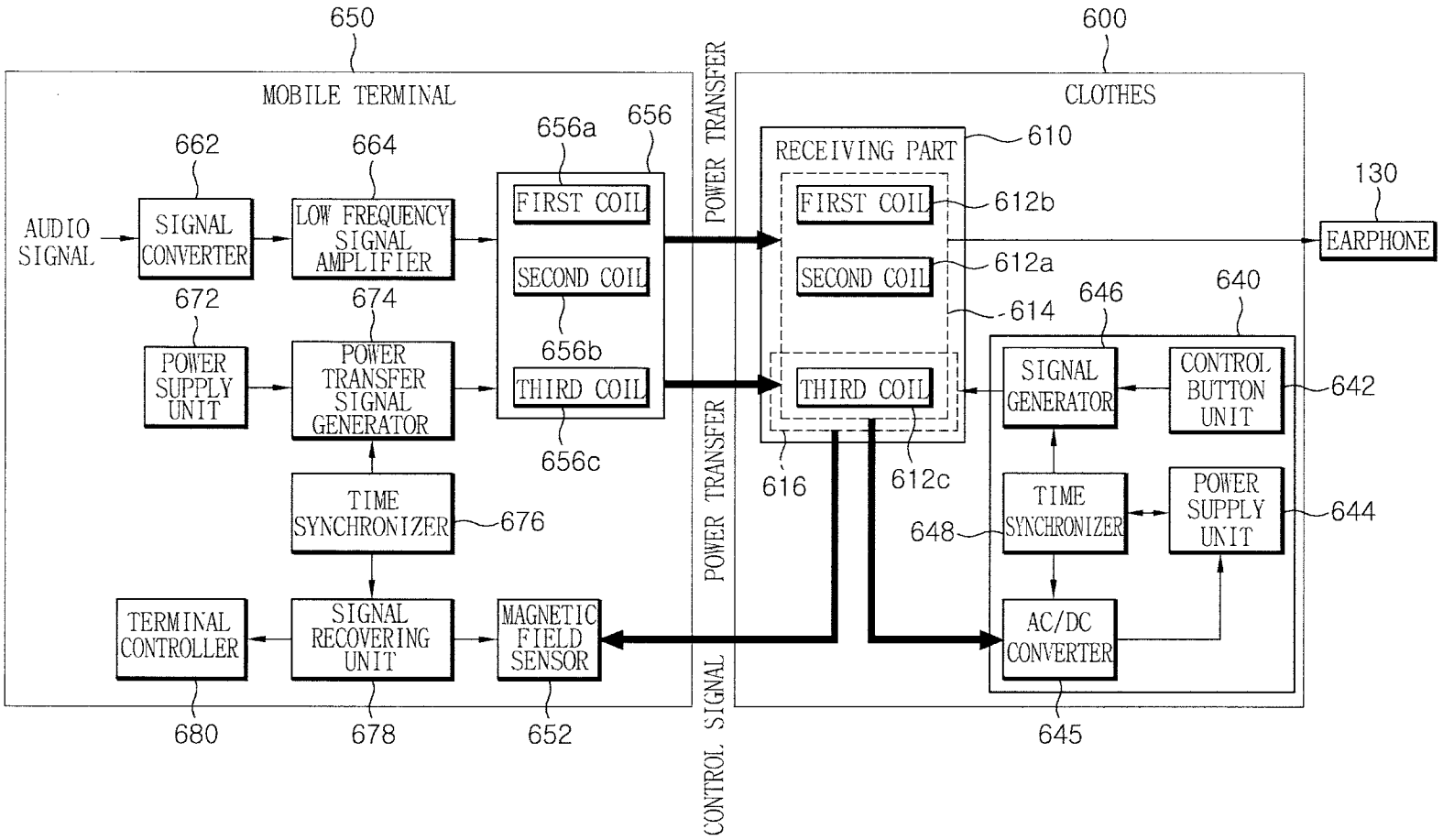
FIG. 10 is a block diagram for explaining in detail a configuration of textile-based magnetic field interface clothes and a mobile terminal in the wearable computing system of FIG. 9.

FIG. 9 is an exemplified diagram for explaining a wearable computing system according to a fifth embodiment of the present invention. FIG. 10 is a block diagram for explaining in detail a configuration of textile-based magnetic field interface clothes and a mobile terminal in the wearable computing system of FIG. 9.

The wearable computing system according to the fifth embodiment of the present invention includes textile-based magnetic field interface clothes 600 (hereinafter, referred to as 'clothes') and a mobile terminal 650.

Referring to FIGS. 9 and 10, the clothes 600 are provided with a receiving part 610 and the mobile terminal 650 of the user is received in the receiving part 610. In this case, it is preferable that a size of the receiving part 610 is the same as that of the mobile terminal 650 or the mobile terminal 650 is formed to have only a slight gap. This is to more stably perform magnetic field communication by increasing a flux density when the mobile terminal 650 performs contactless magnetic field communication with the clothes 600. In the present invention, since the mobile terminal 650 is received close to the clothes 600 in order to perform the magnetic field communication, the mobile terminal can increase signal transfer efficiency having a low power structure while minimizing the signal attenuation phenomenon due to noise by accurately maintaining an axis arrangement at the time of performing the magnetic field communication between the coils having different axis arrangement.

The receiving unit 610 is formed with a secondary coil part 614 performing contactless magnetic field communication with a primary coil part 656 of the mobile terminal 650 and a primary coil part 616 transmitting control signals to a magnetic field sensor 652 of the mobile terminal 650 by using the magnetic induction scheme.

The secondary coil part 614 of the receiving part 610 is configured of a first coil 612*b*, a second coil 612*a*, and a third coil 612*c*, which are made of conductive yarn (a conducting wire in the form of textile).

In this case, each of the first coil 612*b*, the second coil 612*a*, and the third coil 612*c* is formed on the receiving part 610 to have different axis arrangements. For example, the first coil 612*b* is formed to be wound in an X-axis direction along an internal surface or an external surface of the receiving unit 610 and the second coil 612*a* is formed to be wound in a Y-axis direction along the internal surface or the external surface of the receiving part 610. The third coil 612*c* is formed to have a twister shape on a Z-axis arrangement on the internal surface or the outer surface of the receiving part 610 (see FIG. 9).

The first coil 612*b* and the second coil 612*a* of the secondary coil part 614 are electrically connected to the external audio output apparatus 130 (for example, 'earphone') through the conductive yarn 620 formed on the clothes 600. For example, the first coil 612*b* of the secondary coil part 614 may be electrically connected to the R channel 130*a* of the audio output apparatus 130 through the first conductive yarn 620*b* and the second coil 612*a* of the secondary coil part 614 may be electrically connected to the L channel 130*b* of the audio output apparatus 130 through the second conductive yarn 612*a*.

Herein, the first coil 612*b*, the second coil 612*a*, and the third coil 612*c* correspond to a first audio signal receiving coil, a second audio signal receiving coil, and a control signal transmitting coil, respectively, which are described in the claims.

The clothes 600 include a control signal generator 640 that generates the control signals for controlling the operation of the mobile terminal 650 according to the control instructions from the user and the control signal generator 640 is electrically connected to the primary coil part 612*c* (third coil) formed in the receiving part 610 through the conductive yarn 630. Herein, the third coil 612*c* is operated as the secondary coil part 614 that receives the power transfer signals from the primary coil part 656 of the mobile terminal 650 by using the magnetic induction scheme or is operated as the primary coil part 616 that transmits the control signals from the control signal generator 640 to the magnetic field sensor 652 of the mobile terminal 650 by using the magnetic induction scheme. This will be described below in more detail.

The control signal generator 640 includes a control button unit 642, a power supply unit 644, an AC/DC converter 645, a signal generator 646, and a time synchronizer 648.

The control button unit 642 is a user interface unit for receiving the control instructions from the user and is configured in the form of textile.

The signal generator 646 generates the control signals corresponding to the user instructions input through the control button unit 642 and transmits them to the third coil 612*c*. In this case, the signal generator 544 may use a modulation method, such as AM, FM, digital, etc.

The power supply unit 646 performs a role of supplying power necessary to generate the control signals in the signal generator 544 and receives power from the AC/DC converter 645 and stores it.

The AC/DC converter 645 is electrically connected to the third coil 612*c* of the receiving part 610 through the conductive yarn 630, receives alternating current power from the third coil 612*c* and converts it into direct current power, and supplies it to the power supply unit 644.

The time synchronizer 648 is controlled so that each of the signal generator 646 and the AC/DC converter 645 is operated in a time division scheme. More specifically, the time synchronizer 648 is controlled so that when the power transfer signals from the mobile terminal 650 are transmitted to the third coil 612*c*, it converts power in the AC/DC converter 645 and then, stores the converted power in the power supply unit 644. On the other hand, when the power transfer signals from the mobile terminal 650 are not transmitted to the third coil 612*c*, the time synchronizer 648 waits for the user input through the control button unit 642. In other words, the fifth embodiment uses one induction coil 612*c* (third coil) to receive power from the mobile terminal 650 or transmits the control signals generated in the control signal generator 640 to the mobile terminal 650.

Meanwhile, the mobile terminal 650 includes a signal converter 662, a low frequency signal amplifier 664, and the primary coil part 656 includes a magnetic field sensor 652, a power supply unit 672, a power transfer signal generator 674, a time synchronizer 676, a signal recovering unit 678, and a terminal controller 680.

The signal converter 662 receives the audio signals and converts them into a form capable of transmitting the audio signals in the primary coil part 656 by using the magnetic induction scheme.

The signals converted in the signal converter 662 is transmitted to the low frequency signal amplifier 664 and the low frequency signal amplifier 664 receives the converted signals, amplifies signals corresponding to a low frequency band, and transmits them to a first coil 656*a* and a second coil 656*b* of the primary coil part 656.

The audio signals transmitted to the primary coil part 656 are transmitted to the secondary coil part 614 on the clothes 100 by using the magnetic induction scheme and the transmitted signals are output through the audio output apparatus 130 without needing to configure specific circuits on the clothes 600. In other words, the audio signals transmitted to the first coil 656*a* of the primary coil part 656 is transmitted to the first coil 612*b* of the secondary coil part 614 by using the magnetic induction scheme and the audio signals transmitted to the second coil 656*b* of the primary coil part 656 are transmitted to the second coil 612*a* of the secondary coil part 614 by using the magnetic induction scheme.

The power transfer signal generator 674 receives power from the power supply unit 672 and generates power transfer signals for supplying power to the control signal generator 640 on the clothes 600.

The power transfer signals generated in the power transfer signal generator 462 are transmitted to the third coil 656*c* of the primary coil part 656 and the third coil 656*c* transmits the power transfer signals to the third coil 612*c* on the clothes 600 by using the magnetic induction scheme.

Herein, the first coil 656*a*, the second coil 656*b*, and the third coil 656*c* of the primary coil part 656 correspond to the first audio signal transmitting coil, the second audio signal transmitting coil, and the power transfer signal transmitting coil, respectively, which are described in the claims.

The magnetic field sensor 652 senses the control signals transmitted from the third coil 612*c* on the clothes 600 by using the magnetic induction scheme and transmits the sensed control signals to the signal recovering unit 678. As the magnetic field sensor 652, the uniaxial magnetic field sensor for sensing the control signals transmitted from the third coil 612*c* or the magnetic inducible coil can be used.

The signal recovering unit 678 detects the control signals sensed in the magnetic field sensor 452 using the band-pass filter, etc.

The terminal controller 680 controls the operation of the mobile terminal 650 based on the control signals detected through the signal recovering unit 678.

The time synchronizer 676 operates each of the power transfer signal generator 674 and the signal recovering unit 678 in a time division structure. More specifically, the time synchronizer 676 supplies power to the clothes 600 through the third coil 656*c* for a predetermined time and then, confirms whether the control signals from the clothes 600 are sensed through the magnetic field sensor 652 for a predetermined time. The time synchronizer 676 repeats the process and operates the power transfer signal generator 674 and the signal recovering unit 678 in a time division structure.

Sixth Embodiment

Figure 11:
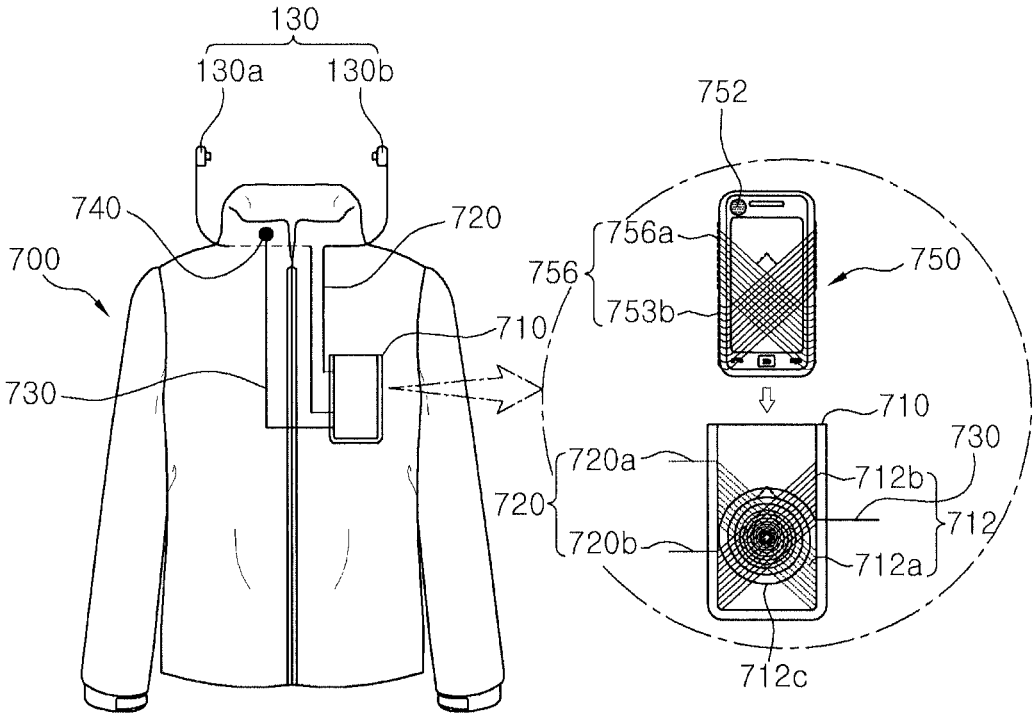
FIG. 11 is an exemplified diagram for explaining a wearable computing system according to a sixth embodiment of the present invention.
Figure 12:
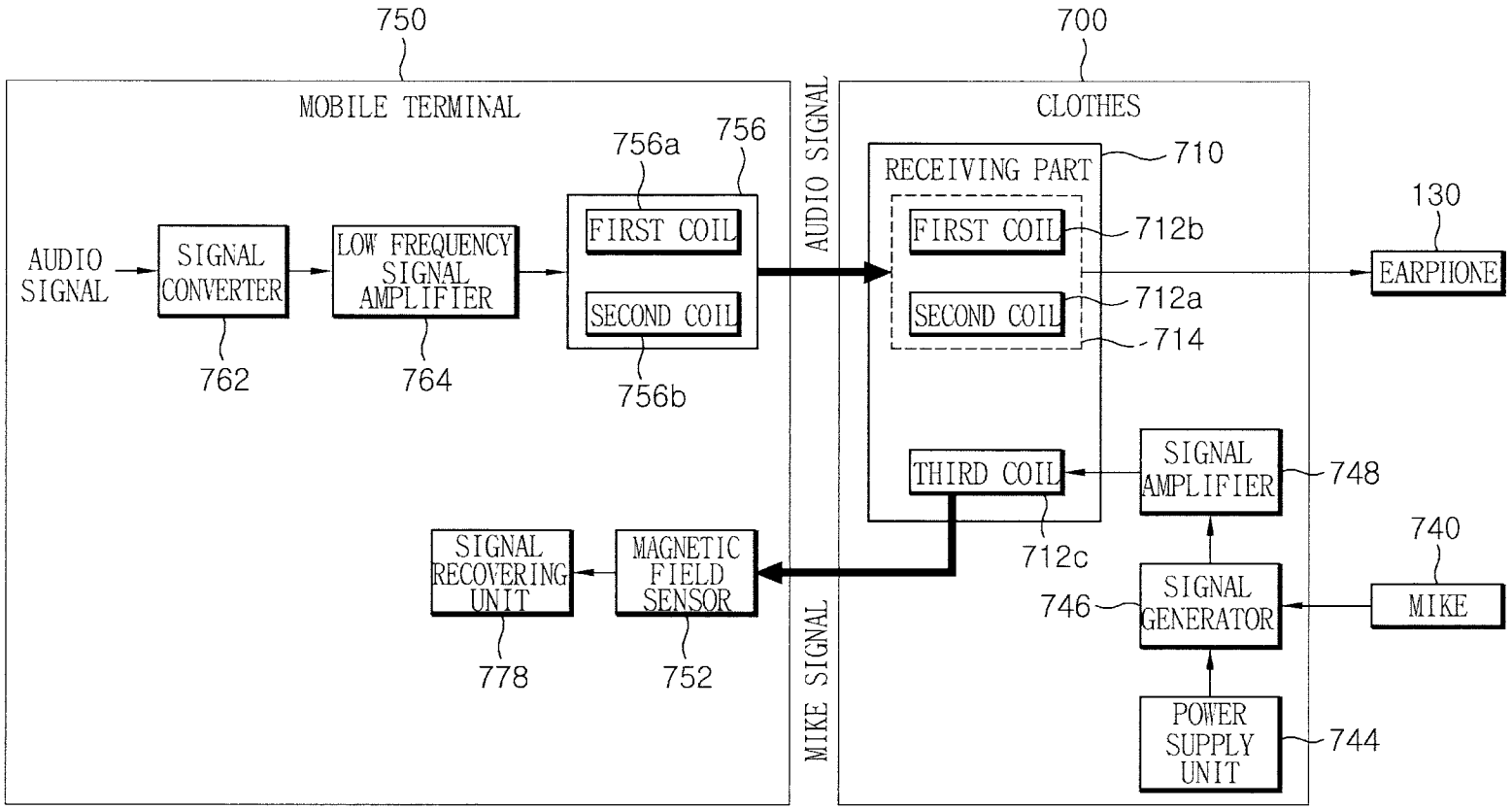
FIG. 12 is a block diagram for explaining in detail a configuration of textile-based magnetic field interface clothes and a mobile terminal in the wearable computing system of FIG. 11.

FIG. 11 is an exemplified diagram for explaining a wearable computing system according to a sixth embodiment of the present invention. FIG. 12 is a block diagram for explaining in detail a configuration of textile-based magnetic field interface clothes and a mobile terminal in the wearable computing system of FIG. 11.

The wearable computing system according to the sixth embodiment of the present invention includes textile-based magnetic field interface clothes 700 (hereinafter, referred to as 'clothes') and a mobile terminal 750.

Referring to FIGS. 9 and 10, the clothes 600 are provided with a receiving part 710 and the mobile terminal 750 of the user is received in the receiving part 710. In this case, it is preferable that a size of the receiving part 710 is the same as that of the mobile terminal 750 or the mobile terminal 750 is formed to have only a slight gap. This is to more stably perform magnetic field communication by increasing a flux density when the mobile terminal 750 performs contactless magnetic field communication with the clothes 700.

The receiving unit 710 is formed with a secondary coil part 714 performing contactless magnetic field communication with a primary coil part 756 of the mobile terminal 750 and a primary coil part 712*c* (third coil) transmitting mike signals to a magnetic field sensor 752 of the mobile terminal 750 by using the magnetic induction scheme.

The secondary coil part 714 of the receiving part 710 is configured of a first coil 712*b* and a second coil 712*a*, which are made of the conductive yarn (a conducting wire in the form of textile).

In this case, each of the first coil 712*b* and the second coil 712*a* is formed on the receiving part 710 to have different axis arrangements. For example, the first coil 712*b* is formed to be wound in an X-axis direction along an internal surface or an external surface of the receiving unit 710 and the second coil 712*a* is formed to be wound in a Y-axis direction along the internal surface or the external surface of the receiving part 710 (see FIG. 11).

The first coil 712*b* and the second coil 712*a* of the secondary coil part 714 are electrically connected to the external audio output apparatus 130 (for example, 'earphone') through the conductive yarn 720 formed on the clothes 700. For example, the first coil 712*b* of the secondary coil part 714 may be electrically connected to the R channel 130*a* of the audio output apparatus 130 through the first conductive yarn 720*b* and the second coil 712*a* of the secondary coil part 714 may be electrically connected to the L channel 130*b* of the audio output apparatus 130 through the second conductive yarn 712*a*.

Herein, the first coil 712*b* and the second coil 712*a* correspond to the first audio signal receiving coil and the second audio signal receiving coil, which are described in the claims. The following third coil 712*c* corresponds to a mike signal transmitting coil, which is described in the claims.

In addition, the receiving part 710 is formed with the primary coil part 712*c* (third coil) made of conductive yarn and the third coil 712*c* is formed in the receiving part 710 to have an axis arrangement different from the first coil 712*b* and the second coil 712*a* of the secondary coil part 714. For example, the third coil 712*c* is formed to have a twister shape in a Z-axis arrangement on the internal surface or the outer surface of the receiving part 710 (see FIG. 11).

The clothes 700 include a signal amplifier 748, a signal generator 746, and a power supply unit 744.

The signal generator 746 is electrically connected to a voice input apparatus 740 (for example, 'mike') through the conductive yarn 730 and receives the user's voice through the voice input apparatus 740 to generate the mike signal. The power supply unit 744 supplies power necessary to generate the mike signals in the signal generator 746 and the signal amplifier 748 amplifies the mike signals generated in the signal generator 746 and transmits them to the third coil 712*c*. Then, the third coil 712*c* receives the mike signals amplified from the signal amplifier 748 and transmits them to the magnetic field sensor 752 by using the magnetic induction scheme.

Meanwhile, the mobile terminal 750 includes a signal converter 762, a low frequency signal amplifier 764, and the primary coil part 756, a magnetic field sensor 752, a power supply unit 672, and a signal recovering unit 678.

The signal converter 762 receives the audio signals and converts them into a form capable of transmitting the audio signals in the primary coil part 756 by using the magnetic induction scheme.

The signals converted in the signal converter 762 are transmitted to the low frequency signal amplifier 764 and the low frequency signal amplifier 764 receives the converted signals, amplifies signals corresponding to a low frequency band, and transmits them to a first coil 756*a* and a second coil 756*b* of the primary coil part 756.

The audio signals transmitted to the primary coil part 756 are transmitted to the secondary coil part 714 on the clothes 700 through the magnetic induction scheme and the transmitted signals are output through the audio output apparatus 130 without needing to configure specific circuits on the clothes 700. In other words, the audio signals transmitted to the first coil 756*a* of the primary coil part 756 is transmitted to the first coil 712*b* of the secondary coil part 714 through the magnetic induction scheme and the audio signals transmitted to the second coil 756*b* of the primary coil part 756 are transmitted to the second coil 712*a* of the secondary coil part 714 through the magnetic induction scheme.

Herein, the first coil 756*a* and the second coil 756*b* correspond to the first audio signal transmitting coil and the second audio signal transmitting coil, which are described in the claims.

The magnetic field sensor 752 senses the mike signals transmitted from the third coil 712*c* on the clothes 700 by the magnetic induction scheme and transmits the sensed mike signals to the signal recovering unit 778. As the magnetic field sensor 752, the uniaxial magnetic field sensor for sensing the control signals transmitted from the third coil 712*c* or the magnetic inducible coil can be used.

The signal recovering unit 778 detects and recovers the mike signals sensed in the magnetic field sensor 752 using the band-pass filter, etc.

Figure 14:
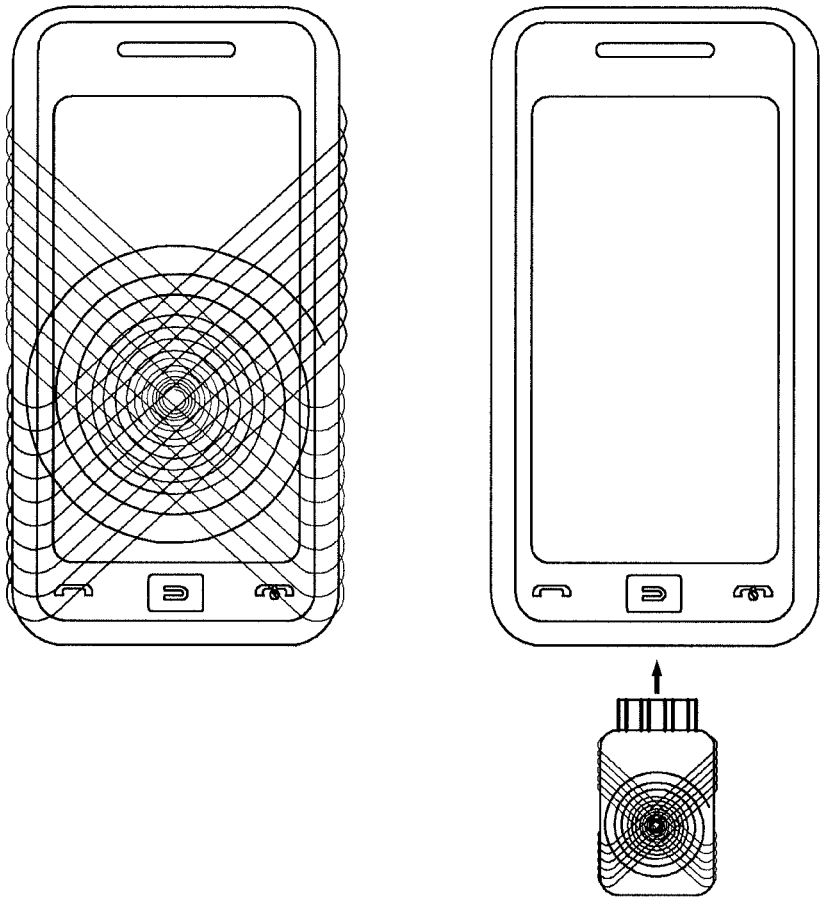
FIG. 14 is a diagram showing one example of a magnetic field interface apparatus applicable to the wearable computing system of the present invention.

FIG. 14 is a diagram showing one example of a magnetic field interface apparatus applicable to the wearable computing system of the present invention.

Meanwhile, the foregoing descriptions and drawings describe the case where the primary coil part and the secondary coil part are built in the mobile terminal, as shown at the left of FIG. 14. However, in order to perform the magnetic field communication with the textile-based magnetic field interface clothes of the present invention, the magnetic field interface apparatus can be implemented as a dongle type of a magnetic field interface apparatus connected to the connector (for example, a USB connector, a TTA 24 pin connector, etc.) of the mobile terminal, as shown at the right of FIG. 14. In this case, the coil shape and function implemented on the magnetic field interface can be easily derived from those skilled in the art through the foregoing descriptions and drawings. Therefore, the detailed description thereof will be omitted.

Since the magnetic field interface clothes in the wearable computing system according to the present invention performs the communication with the mobile terminal by using the magnetic field, it can be implemented without using the wireless communication module (including a power supply at both ends thereof) by directly connecting the connector or using the RF. In addition, since the wearable computing system according to the present invention can be applied to any portions of clothes and the clothes and the mobile terminal perform near-magnetic field communication, the security of communication is excellent.

Some steps of the present invention can be implemented as a computer-readable code in a computer-readable recording medium. The computer-readable recording media include all types of recording apparatuses where data can be read by a computer system is stored. Examples of the computer-readable recording media include ROM, RAM, CD-ROM, CD-RW, a magnetic tape, a floppy disk, HDD, an optical disk, an optical magnetic storage device, etc., and in addition, include a recording medium implemented in the form of a carrier wave (for example, transmission through the Internet). Further, the computer-readable recording media are distributed on computer systems connected through the network, and thus the computer-readable recording media may be stored and executed as the computer-readable code by a distribution scheme.

As described above, the exemplary embodiments have been described and illustrated in the drawings and the description. Herein, specific terms have been used, but are just used for the purpose of describing the present invention and are not used for qualifying the meaning or limiting the scope of the present invention, which is disclosed in the appended claims. Therefore, it will be appreciated to those skilled in the art that various modifications are made and other equivalent embodiments are available. Accordingly, the actual protection of the technical scope of the present invention must be determined by the spirit of the appended claims.

What is claimed is:

1. Magnetic field interface clothes performing contactless magnetic field communication with a mobile terminal, comprising:

a receiving part in which a mobile terminal is received and a coil part performing contactless magnetic field communication with a coil part of the mobile terminal at a position facing a coil part of the mobile terminal is formed, wherein the coil part formed in the receiving part includes:

a first audio signal receiving coil that receives an L channel audio signal by using a magnetic induction scheme from the coil part of the mobile terminal; and a second audio signal receiving coil formed to have an axis arrangement different from the first audio signal receiving coil on the receiving part when receiving an R channel audio signal from the coil part of the mobile terminal by using the magnetic induction scheme.

2. The magnetic field interface clothes according to claim 1, wherein the first audio signal receiving coil and the second audio signal receiving coil are formed in the receiving part to have different winding directions.

3. The magnetic field interface clothes according to claim 1, wherein the coil part formed in the receiving part further includes a control signal transmitting coil formed in the receiving part, the control signal transmitting coil having a different winding direction from the winding directions of the first audio signal receiving coil and the second audio signal receiving coil, and the control signal transmitting coil transmits the control signals for controlling the operation of the mobile terminal to a magnetic field sensor of the mobile terminal by using the magnetic induction scheme.

4. The magnetic field interface clothes according to claim 3, further comprising:

a signal generator that generates control signal for controlling the operation of the mobile terminal according to control instructions from a user and transmits the generated control signals to the control signal transmitting coil;

an AC/DC converter that is input with alternating current power through the control signal transmitting coil and converts and stores the input alternating power into direct current power;

and a time synchronizer that controls the operations of the signal generator and the AC/DC converter so that the signal generator and the AC/DC converter are operated in a time division scheme.

5. The magnetic field interface clothes according to claim 1, wherein the coil part received in the receiving part further includes a mike signal transmitting coil formed in the receiving part, the mike signal transmitting coil having a different winding direction from the winding directions of the first audio signal receiving coil and the second audio signal receiving coil, and the mike signal transmitting coil transmits mike signals input through the mike to the magnetic field sensor of the mobile terminal by using the magnetic induction scheme.

6. Magnetic field interface clothes performing contactless magnetic field communication with a mobile terminal, comprising:

a receiving part in which a mobile terminal is received and a coil part performing contactless magnetic field communication with a coil part of the mobile terminal at a position facing a coil part of the mobile terminal is formed, wherein the coil part formed in the receiving part includes:

a first audio signal receiving coil that receives an L channel audio signal by using a magnetic induction scheme from the coil part of the mobile terminal; and a second audio signal receiving coil that receives an R channel audio signal from the coil part of the mobile terminal by using the magnetic induction scheme, the first audio signal receiving coil and the second audio signal receiving coil are formed in the receiving part to have different winding directions, and wherein the winding direction of the first audio signal receiving coil and the winding direction of the second audio signal receiving coil are orthogonal to each other.

7. A mobile terminal received in magnetic field interface clothes and performing contactless magnetic field communication with the magnetic field interface clothes, comprising:

a coil part performing the contactless magnetic field communication with a coil part of the magnetic field interface at a position facing a coil part of the magnetic field interface clothes is formed, wherein the coil part performing the contactless magnetic field communication with the coil part of the magnetic field interface clothes includes:

a first audio signal transmitting coil that transmits an L channel audio signal to the coil part of the magnetic field interface clothes through a magnetic induction scheme; and a second audio signal transmitting coil formed to have an axis arrangement different from the first audio signal transmitting coil when transmitting an R channel audio signal to the coil part of the magnetic field interface clothes by using the magnetic induction scheme.

8. The mobile terminal according to claim 7, wherein the first audio signal transmitting coil and the second audio signal transmitting coil are formed to have different winding directions.

9. The mobile terminal according to claim 8, wherein the winding direction of the first audio signal transmitting coil and the winding direction of the second audio signal transmitting coil are orthogonal to each other.

10. The mobile terminal according to claim 7, further comprising a magnetic field sensor that receives control signals for controlling the operation of the mobile terminal, which are transmitted from the coil part of the magnetic field interface clothes by using the magnetic induction scheme.

11. The mobile terminal according to claim 10, wherein the coil part performing the contactless magnetic field communication with the coil part of the magnetic field interface clothes further includes a power transfer signal transmitting coil that transmits power transfer signals to the coil part of the magnetic field interface clothes by using the magnetic induction scheme.

12. The mobile terminal according to claim 7, further comprising a magnetic field sensor that receives mike signals transmitted from the coil part of the magnetic field interface clothes by using the magnetic induction scheme.

13. The mobile terminal according to claim 7, wherein the first audio signal transmitting coil and the second audio signal transmitting coil are formed in the external apparatus that is connected to the external connector of the mobile terminal.

* * * * *